US007690088B2

(12) United States Patent
Kogen

(10) Patent No.: US 7,690,088 B2
(45) Date of Patent: Apr. 6, 2010

(54) MAGNETIC CLASP FOR JEWELRY INCLUDING SAFETY CATCH AND ALIGNMENT MEANS

(75) Inventor: Robert A. Kogen, Plymouth Meeting, PA (US)

(73) Assignee: L. Lawrence Products, Inc., Huntingdon Valley, PA (US)

( * ) Notice: Subject to any disclaimer, the term of this patent is extended or adjusted under 35 U.S.C. 154(b) by 232 days.

(21) Appl. No.: 11/946,378

(22) Filed: Nov. 28, 2007

(65) Prior Publication Data

US 2009/0133229 A1 May 28, 2009

(51) Int. Cl.
*A44B 11/25* (2006.01)

(52) U.S. Cl. ..... 24/303; 24/616

(58) Field of Classification Search ..... 24/303, 24/DIG. 52, 616, 574.1; 63/3.1, 900
See application file for complete search history.

(56) References Cited

U.S. PATENT DOCUMENTS

| | | | | |
|---|---|---|---|---|
| 2,615,227 | A | 10/1952 | Hornik | |
| 2,648,884 | A | 8/1953 | Loofboro | |
| 2,975,497 | A | 3/1961 | Budreck | |
| 3,129,477 | A | 4/1964 | Mizuno | |
| 4,520,537 | A * | 6/1985 | Valikov | 24/616 |
| 4,901,405 | A | 2/1990 | Grover et al. | |
| 5,008,984 | A | 4/1991 | Levy | |
| 5,050,276 | A | 9/1991 | Pemberton | |
| 5,197,168 | A * | 3/1993 | Levy | 24/303 |
| 5,317,789 | A | 6/1994 | Levy | |
| 5,664,298 | A | 9/1997 | Nessar-Ivanovic | |
| 6,591,462 | B2 * | 7/2003 | Fuhrman | 24/303 |
| 6,640,398 | B2 | 11/2003 | Hoffman | |
| 7,073,232 | B1 | 7/2006 | Fuhrman et al. | |
| 2002/0007647 | A1 * | 1/2002 | Kahan | 63/3.1 |

* cited by examiner

*Primary Examiner*—Victor Batson
*Assistant Examiner*—Rowland D Do
(74) *Attorney, Agent, or Firm*—Caesar, Rivise, Bernstein, Cohen & Pokotilow, Ltd.

(57) ABSTRACT

A magnetic clasp for an article of jewelry is provided. The clasp includes a pair of mating male and female members, an alignment groove on one member, and associated alignment projection on the other member and a safety catch. The pair of mating male and female members are arranged to be magnetically coupled to each other. The safety catch is arranged to be moved to a locked position to mechanically releasably secure the male and female members together when they are aligned. The alignment groove is shaped to facilitate and guide the projection into it when the two members are magnetically coupled and appropriately aligned so that the safety catch can be moved to the closed position to thereby releasably lock the members together.

10 Claims, 1 Drawing Sheet

MAGNETIC CLASP FOR JEWELRY INCLUDING SAFETY CATCH AND ALIGNMENT MEANS

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

This invention relates generally to jewelry fasteners and more particularly to magnetic clasps for necklaces, bracelets and the like.

Many types of jewelry fasteners or clasps have been disclosed in the patent literature making use of one or two magnets to magnetically couple the two members forming the clasp to each other. Examples of such prior art devices are shown in U.S. Pat. No. 2,615,227 (Hornik); U.S. Pat. No. 2,648,884 Loofboro); U.S. Pat. No. 2,975,497 (Budreck); U.S. Pat. No. 3,129,477 (Mizuno); U.S. Pat. No. 4,901,405 (Grover et al.); U.S. Pat. No. 5,008,984 (Levy); U.S. Pat. No. 5,050,276 (Pemberton); U.S. Pat. No. 5,317,789 (Levy); U.S. Pat. No. 5,664,298 (Nessar-Ivanovic); U.S. Pat. No. 6,640,398 (Hoffman); and U.S. Pat. No. 7,073,232 (Fuhrman). Some of those prior art clasps also make use of a mechanical catch in combination with the two magnetically coupled components of the clasp to ensure that those components do not become disconnected accidentally if all that is holding them together is their magnetic attraction to each other. The use of the mechanical catches, while providing the advantage of reducing the chances of accidental disconnection of the two magnetically coupled members, are not without their own drawbacks. In this regard some prior art magnetic clasps with mechanical safety catches are relatively complex in construction. Others require specific alignment of the components of the clasp to effect their connection so that they do not become disconnected accidentally.

Thus, a need exists for a clasp that overcomes the disadvantages of the prior art. The subject invention addresses that need by providing a magnetic clasp for jewelry which includes a mechanical catch to ensure that the magnetically coupled members making up the clasp do not become accidentally disengaged, while facilitating the alignment of those members to effect their securement to each other in a manner resistant to accidental disconnection.

BRIEF SUMMARY OF THE INVENTION

In accordance with one aspect of this invention there is provided a magnetic clasp for an article of jewelry, e.g., a necklace, bracelet or the like. The clasp basically comprises a pair of mating male and female members, a safety catch and alignment means. The pair of mating male and female members are arranged to be magnetically coupled to each other to secure the clasp. The safety catch is a mechanically operating member arranged to be moved to a locked position to mechanically releasably secure the male and female members together when they are aligned. The alignment means is arranged for facilitating the alignment of the male and female members so that the safety catch can be moved to the locked position. The alignment means basically comprises a recess in one of the male and female members and a projection in the other of the mating male and female members. The projection of one member is arranged to be located within the recess of the other member when the members are aligned.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE PREFERRED EMBODIMENTS OF THE INVENTION

Figure 1:
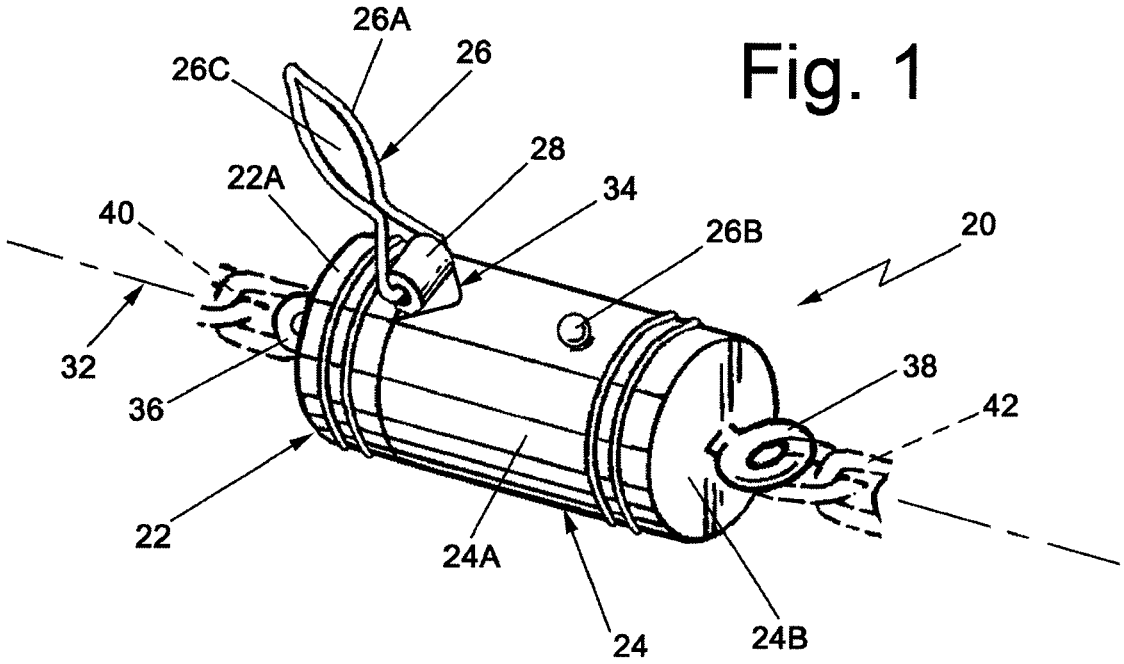
FIG. 1 is an isometric view of one exemplary embodiment of a jewelry clasp constructed in accordance with this invention.
Figure 2:
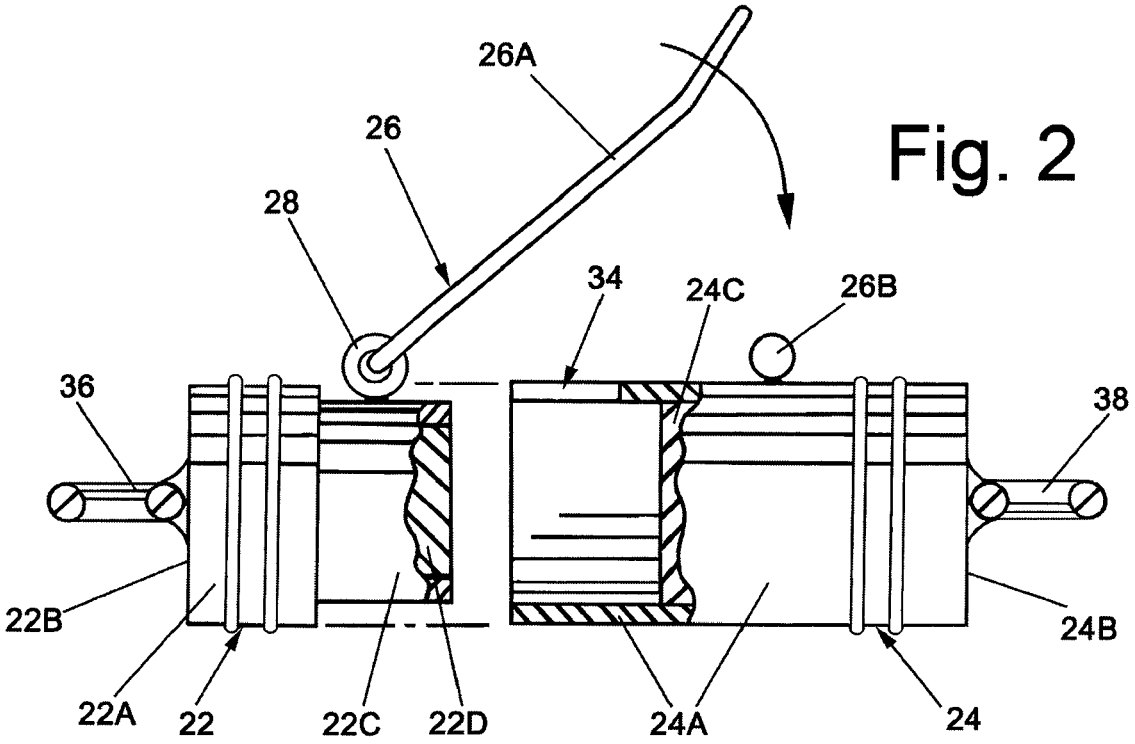
FIG. 2 is an enlarged side elevational view, partially in section showing the two mating members making up the clasp of FIG. 1.

Referring now to the various figures of the drawing, wherein like reference numbers refer to like parts, there is shown at 20 in FIGS. 1 and 2 one exemplary closure or clasp constructed in accordance with this invention. The clasp basically comprises a pair of sections or members 22 and 24 which are arranged to be releasably secured to each other by means of magnetic attraction, as will be described in detail later. In order to ensure that the two sections do not become accidentally disconnected, notwithstanding their magnetic attraction to each other, a mechanical safety catch assembly 26 is provided. The details of the safety catch assembly will be described later. Suffice it for now to state that it is of a conventional construction like that commonly found on the clasps of bracelets and necklaces.

The two members 22 and 24 making up the clasp 20 are preferably constructed so that when they are connected to each other they mate. To that end, in the exemplary embodiment shown the member 22 constitutes a male member, while the member 24 constitutes a female member. This is merely exemplary. Thus, it is contemplated that the member 24 may comprise the male member while the member 22 comprises the female member. The male member is of a barrel-like shape and includes a side wall 22A and an end wall 22B. The side wall 22A is of circular cross section. The inner end portion 22C of the side wall 22A is of a slightly reduced diameter for the reason to be described later. A cylindrically shaped permanent magnet 22D is located within the cylindrically shaped hollow interior of the male member 22. The female member 24 is also of a barrel-like shape and includes a side wall 24A and an end wall 24B. The side wall 24A is of circular cross section and is of the same outside diameter as the outside diameter of the side wall portion 22A of the male member 22 so that when the two members of the clasp are connected together the clasp is of a generally constant outside diameter. The inside diameter of the side wall 24A of the female member 24 is just slightly larger than the outside diameter of the inner end portion 22C of the side wall of the male member 22 in order to receive the male member therein. A cylindrically shaped permanent magnet 24C is located within the hollow interior of the female member 24.

In the exemplary preferred embodiment shown herein the inner end of the magnet 22D is arranged to abut or at least lie immediately adjacent the inner end of the magnet 24C when the male member 22 is received within the female member 24. This action magnetically couples the two members 22 and 24 to each other, thereby holding the clasp 20 in a closed state. The magnets 22D and 24C are preferably sufficiently strong so that the magnetic engagement of them to each other is resistant to accidental disconnection, yet is not too strong to interfere with the manual separation of them when it is desired to take the clasp apart, e.g., to remove the piece of jewelry from the wearer.

It should be noted at this juncture that the subject clasp need not include two magnets as shown and described. Thus, it is contemplated that either the male or female member may include a magnet, while the other member includes a piece of metal or other material that is attracted to the magnet.

In order to ensure that the mating members 22 and 24 of the clasp 20 don't become accidentally disconnected notwithstanding the magnetic attraction between them, the clasp includes the heretofore identified catch assembly 26. That assembly basically comprises a catch element 26A and a ball or keeper element 26B. In the exemplary embodiment the catch element 26A is pivotably connected via a hinge 28 to the outer surface of the side wall portion 22C of the male member 22. The ball element 26B is fixedly secured to the outer wall 24A of the female member 24. The catch element 26A is arranged to be pivoted from the open position or orientation shown in FIG. 1 downward, in the direction of the arrow shown in FIG. 2, so that the ball element 26B snap-fits within the hollow interior space 26D of the catch element 26A.

As will be appreciated by those skilled in the art, in order for the ball element 26B to be received within the interior space of the catch element 26A those two members must be axially aligned. Since the two members 22 and 24 of the clasp 20 are of cylindrical cross section they can be mated so that they are at any orientation about the common longitudinal axis 32, whereupon the ball element and the catch element may not be axially aligned. Such misalignment will preclude their interconnection. Thus, in order to ensure that misalignment between the catch element 26A and the ball element 26B doesn't occur, the clasp 20 includes means 34 for facilitating the axial alignment of those two elements. In the exemplary embodiment that alignment means basically comprises a portion of the male member (to be described later) and a V-shaped recess or groove 34 located in the peripheral edge of the side wall 24A of the female member 24. The groove 34 is axially aligned with the ball element 26B and is arranged to receive and guide the other component of the alignment means. That other component constitutes a projection, e.g., the heretofore identified hinge 28 of the male member 22. This ensures that the catch element 26A is axially aligned with the ball element 26B. In particular, in order to properly align the catch element 26A to the ball element 26B all that is required is to juxtapose the male member 22 with respect to the female member 24 so that the inner end of the male member enters into the open inner end of the female member and with the hinge 28 generally located opposite the V-shaped groove 34. Pushing the two members 22 and 24 toward each other causes the inclined edge of the groove 34 to guide the hinge 28 into position to the bottom of the groove, whereupon the catch element will be precisely located with respect to the ball element, i.e., the hollow interior portion 26C of the catch element is at the appropriate position. Thus, when the catch element 26A is pivoted down in the direction of the arrow in FIG. 2 it will snap-fit over the ball element 26B to releasably secure the two elements of catch assembly together, thereby mechanically fastening the members 22 and 24 of the clasp 20 together.

It should be pointed out at this juncture that other means can be used in lieu of the use of the hinge 28 as the projection component to fit in and be guided by the V-shaped recess or groove 34 to align the catch element 26A to the ball element 26B. Thus, any projection located on any portion of the periphery of the inner end 22C of the male member can be used to fit within a recess or groove 34 in a portion of the periphery of the inner end of the female member 24, providing that the groove and the projection are located so that when the projection is received within the groove the catch element 26A is axially aligned with the ball element 26B. Moreover, it is contemplated that the projection and groove can be reversed, i.e., the groove may be provided in the peripheral edge of the inner portion of the male member 22, while a projection is located extending radially inward from the inner surface of the side wall of the female member 24.

In order to mount the respective sections of the clasp to respective ends of a bracelet, necklace or any other item for which the clasp may be used, the clasp includes a pair of mounting rings 36 and 36. In particular, a mounting ring 36 is fixedly secured to the outside surface of the end wall 22B of the male member 22 centered on the longitudinal axis 32, while a similar mounting ring 38 is fixedly secured to the outside of the end wall 24B of the male member 24 also centered on the longitudinal axis. The mounting ring 36 may be directly connected to a link forming one end 40 of the bracelet, necklace, etc., while the mounting ring 38 may be directly connected to a link forming the opposite end 42 of the bracelet, necklace, etc.

It should be pointed out at this juncture that the shape of the two sections or members 22 and 24 is purely a matter of design. Thus, those members can be of other shapes than the cylindrical shapes shown. For example, they may be parallelepiped in shape. Moreover, the members 22 and 24 can be formed of any suitable material, e.g., gold, platinum, silver or some other less expensive metal and be coated or uncoated. The outer surface of the two members 22 and 24 may include surface ornamentation, e.g., the ridges shown in the exemplary embodiment or any other surface feature/texture, to provide an aesthetically pleasing appearance.

While one preferred use of the clasp of the subject invention is for releasably securing two ends of a necklace or bracelet together, it will be understood that it is within the scope of this invention to employ the clasp of this invention, with appropriate modification where necessary as a fastener for other types of jewelry or other types of articles, garments, belts, etc.

While the invention has been described in detail and with reference to specific embodiments thereof, it will be apparent to one skilled in the art that various changes and modifications can be made therein without departing from the spirit and scope thereof.

What is claimed is:

1. A magnetic clasp for an article of jewelry comprising a pair of mating male and female members arranged to be magnetically coupled to each other along a common longitudinal axis, a safety catch arranged to be moved to a locked position to mechanically releasably secure said male and female members together when said members are aligned, and alignment means for facilitating the alignment of said male and female members so that said safety catch can be moved to said locked position, said alignment means comprising a recess in one of said male and female members and a projection in the other of said mating male and female members, said projection being complimentary shaped and arranged to be located within said recess when said mating male and female member are aligned to prevent twisting of either of said male and female members with respect to each other about said common longitudinal axis before said safety catch is moved to said locked position.

2. The magnetic clasp of claim 1 wherein the recess is shaped to guide the projection into it.

3. The magnetic clasp of claim 1 wherein said safety catch comprises a hook element pivotably connected to said one of said male and female members and a cooperating catch element connected to said other of said male and female members, said hook element being arranged to be pivoted to engage said catch element to effect the releasable locking of said male and female members together.

4. The magnetic clasp of claim 1 wherein each of said male and female members are each of a general barrel shape having a hollow interior, and wherein at least one of said male and female members includes a magnet located within said hollow interior.

5. The magnetic clasp of claim 2 wherein the recess is generally V-shaped.

6. The magnetic clasp of claim 2 wherein said safety catch comprises a hook element pivotably connected to said one of said male and female members and a cooperating catch element connected to said other of said male and female members, said hook element being arranged to be pivoted to engage said catch element to effect the releasable locking of said male and female members together.

7. The magnetic clasp of claim 3 wherein said projection comprises a portion of said safety catch.

8. The magnetic clasp of claim 6 wherein said projection comprises a portion of said safety catch.

9. The magnetic clasp of claim 7 wherein said hook element is mounted on said male member and said catch element is mounted on said female member.

10. The magnetic clasp of claim 8 wherein said hook element is mounted on said male member and said catch element is mounted on said female member.

* * * * *